US010980391B2

(12) United States Patent
Rockwell

(10) Patent No.: US 10,980,391 B2
(45) Date of Patent: Apr. 20, 2021

(54) APPLIANCE WITH ACOUSTICALLY INSULATED DUCTWORK

(71) Applicant: Owens Corning Intellectual Capital, LLC, Toledo, OH (US)

(72) Inventor: Anthony Lee Rockwell, Pickerington, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 211 days.

(21) Appl. No.: 15/965,225

(22) Filed: Apr. 27, 2018

(65) Prior Publication Data

US 2018/0310796 A1 Nov. 1, 2018

Related U.S. Application Data

(60) Provisional application No. 62/491,575, filed on Apr. 28, 2017.

(51) Int. Cl.
*A47L 15/00* (2006.01)

(52) U.S. Cl.
CPC ..... *A47L 15/0052* (2013.01)

(58) Field of Classification Search
None
See application file for complete search history.

(56) References Cited

U.S. PATENT DOCUMENTS 1,190,292 A 7/1916 Hopkins
2,089,492 A 8/1937 Lambert
2,253,310 A 8/1941 Smellie
2,328,236 A 8/1943 Stoner
2,489,048 A 11/1949 Rinehart
2,534,811 A 12/1950 Corlett, Jr.
3,000,464 A 9/1961 Walters
3,019,850 A 2/1962 March
3,132,717 A 5/1964 Baruch
3,175,586 A 3/1965 Tatsch
3,374,856 A 3/1968 Wirt
3,552,445 A 1/1971 Andrews
3,570,545 A 3/1971 Benteler
3,717,527 A 2/1973 Benteler
3,768,523 A 10/1973 Schroeder
3,807,420 A 4/1974 Donselman et al.
3,903,928 A 9/1975 Sykes et al.
4,121,686 A 10/1978 Keller
4,190,131 A 2/1980 Robinson
4,404,992 A 9/1983 Sasaki et al.
4,421,202 A 12/1983 Hoy
4,442,585 A 4/1984 McGehee, Sr. et al.
4,508,486 A 4/1985 Tinker
4,596,921 A 6/1986 Hersh et al.
(Continued)

FOREIGN PATENT DOCUMENTS

GB 2253035 A 8/1992
WO 1999017047 A1 4/1999
(Continued)

*Primary Examiner* — Cristi J Tate-Sims
(74) *Attorney, Agent, or Firm* — Calfee, Halter & Griswold LLP

(57) ABSTRACT

A home appliance having a housing, an internal compartment within the housing, and a first duct extending from the internal compartment to an area exterior to the housing. The first duct formed from at least one sound absorbing material.

20 Claims, 6 Drawing Sheets

(56) References Cited

U.S. PATENT DOCUMENTS

| | | | | |
|---|---|---|---|---|
| 4,615,411 | A | 10/1986 | Breitscheidel et al. | |
| 4,752,431 | A | 6/1988 | Knowles | |
| 4,788,090 | A | 11/1988 | Marks et al. | |
| 5,162,622 | A | 11/1992 | Malmsten | |
| 5,400,830 | A | 3/1995 | Stiles et al. | |
| 5,428,973 | A | 7/1995 | Temmyo et al. | |
| 5,487,412 | A | 1/1996 | Matthews et al. | |
| 5,548,093 | A | 8/1996 | Sato et al. | |
| 5,731,557 | A | 3/1998 | Norres et al. | |
| 5,795,634 | A | 8/1998 | Fukui | |
| 5,801,342 | A | 9/1998 | Hultberg et al. | |
| 5,918,644 | A | 7/1999 | Haack et al. | |
| 5,965,851 | A | 10/1999 | Herreman et al. | |
| 6,062,270 | A | 5/2000 | Hultberg et al. | |
| 6,179,009 | B1 | 1/2001 | Fukui | |
| 6,202,702 | B1 * | 3/2001 | Ohira | F16L 59/021 138/141 |
| 6,234,211 | B1 | 5/2001 | Lepoutre | |
| 6,273,144 | B1 | 8/2001 | Bohon et al. | |
| 6,305,429 | B1 | 10/2001 | Welch et al. | |
| 6,324,720 | B1 | 12/2001 | Beckey et al. | |
| 6,425,419 | B1 | 7/2002 | Attra | |
| 6,543,575 | B1 | 4/2003 | Marcellus | |
| 6,782,922 | B1 | 8/2004 | Migliorini et al. | |
| 7,028,416 | B1 | 4/2006 | Dobie et al. | |
| 7,159,620 | B2 | 1/2007 | Kissell | |
| 7,754,122 | B2 | 7/2010 | Fay | |
| 8,015,848 | B2 | 9/2011 | Colon et al. | |
| 8,257,812 | B2 | 9/2012 | Youn et al. | |
| 8,371,338 | B2 | 2/2013 | Princell et al. | |
| 8,459,407 | B2 | 6/2013 | Jangili | |
| 8,739,837 | B2 | 6/2014 | Kroll et al. | |
| 8,899,377 | B2 | 12/2014 | Thomas | |
| 9,145,997 | B2 | 9/2015 | Jang et al. | |
| 9,714,480 | B2 * | 7/2017 | Rockwell | D06F 39/12 |
| 9,784,469 | B2 | 10/2017 | Ramos et al. | |
| 2001/0015302 | A1 | 8/2001 | Lundgren | |
| 2002/0134615 | A1 * | 9/2002 | Herreman | A47B 77/022 181/290 |
| 2005/0092384 | A1 | 5/2005 | Curb et al. | |
| 2006/0169341 | A1 | 8/2006 | Goetchius et al. | |
| 2008/0001431 | A1 * | 1/2008 | Thompson | B32B 5/26 296/187.01 |
| 2008/0196266 | A1 | 8/2008 | Jung et al. | |
| 2009/0269219 | A1 | 10/2009 | Langbein et al. | |
| 2010/0071797 | A1 | 3/2010 | Jungers | |
| 2013/0291990 | A1 | 11/2013 | Nagarajan et al. | |
| 2014/0060597 | A1 * | 3/2014 | Welch | A47L 15/4246 134/58 D |
| 2016/0265797 | A1 | 9/2016 | Bull et al. | |
| 2017/0258291 | A1 | 9/2017 | Dirisala et al. | |
| 2017/0258292 | A1 * | 9/2017 | Dirisala | A47L 15/483 |

FOREIGN PATENT DOCUMENTS

| | | | |
|---|---|---|---|
| WO | 1999017048 | A1 | 4/1999 |
| WO | 2012097948 | A2 | 7/2012 |

* cited by examiner

APPLIANCE WITH ACOUSTICALLY INSULATED DUCTWORK

RELATED APPLICATIONS

This application claims benefit of priority to U.S. Provisional Patent Application No. 62/491,575, filed Apr. 28, 2017, which is incorporated herein by reference in its entirety.

FIELD

This invention relates in general to home appliances. More particularly, this invention pertains to home appliances having acoustically insulated ductwork.

BACKGROUND

In a residential dwelling, excessive noise may be generated by home appliances, such as clothes washing machines and dishwashers, which can be annoying to inhabitants of the dwelling. The unwanted sound from these machines can be caused both by the mechanical operation of the motor or other mechanical components within the machine and by the vibration of the machine itself. In some appliances, the ductwork within the appliance can be a factor in transmitting the unwanted noise. Some home appliances may have an inner compartment, such as the tub of a clothes washing machine or a dishwasher, that is connected to an area exterior to the appliance by a duct which allows air into or out of the tub. For example, due to the potential risk of a child being trapped inside the compartment, such appliances are required to have a safety air duct extending from the inner compartment to the exterior of the appliance. The safety air duct must be an open (unobstructed) passage of a certain diameter or width. Further, some dishwashers that include a drying cycle include a duct to vent warm, moist air from the inner compartment to the exterior of the appliance during the drying cycle. Unwanted noise can be transmitted through these ducts.

SUMMARY

A home appliance having acoustically insulated ductwork is disclosed. In one embodiment, the home appliance has a housing, an internal compartment within the housing, and a first duct extending from the internal compartment to the housing. The first duct formed from at least one sound absorbing material.

In another embodiment the home appliance is a washing machine having a housing, a basket rotatably mounted within the housing and configured to retain laundry items during the washing cycle, a detergent dispenser, and a first duct extending from the basket to an exterior of the housing or to the detergent dispenser. The first duct is formed from at least one sound absorbing material.

BRIEF DESCRIPTION OF THE DRAWINGS

The accompanying drawings, which are incorporated in and form a part of this specification, illustrate several aspects of the present invention, and, together with the description, serve to explain certain principles of the invention. In the drawings.

DESCRIPTION OF EMBODIMENTS

The present invention will now be described with occasional reference to various specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." The term "about," as used herein, is defined as up to plus or minus 2% deviation from a stated number or state range to account for typical variations and tolerances. Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements.

Figure 1:
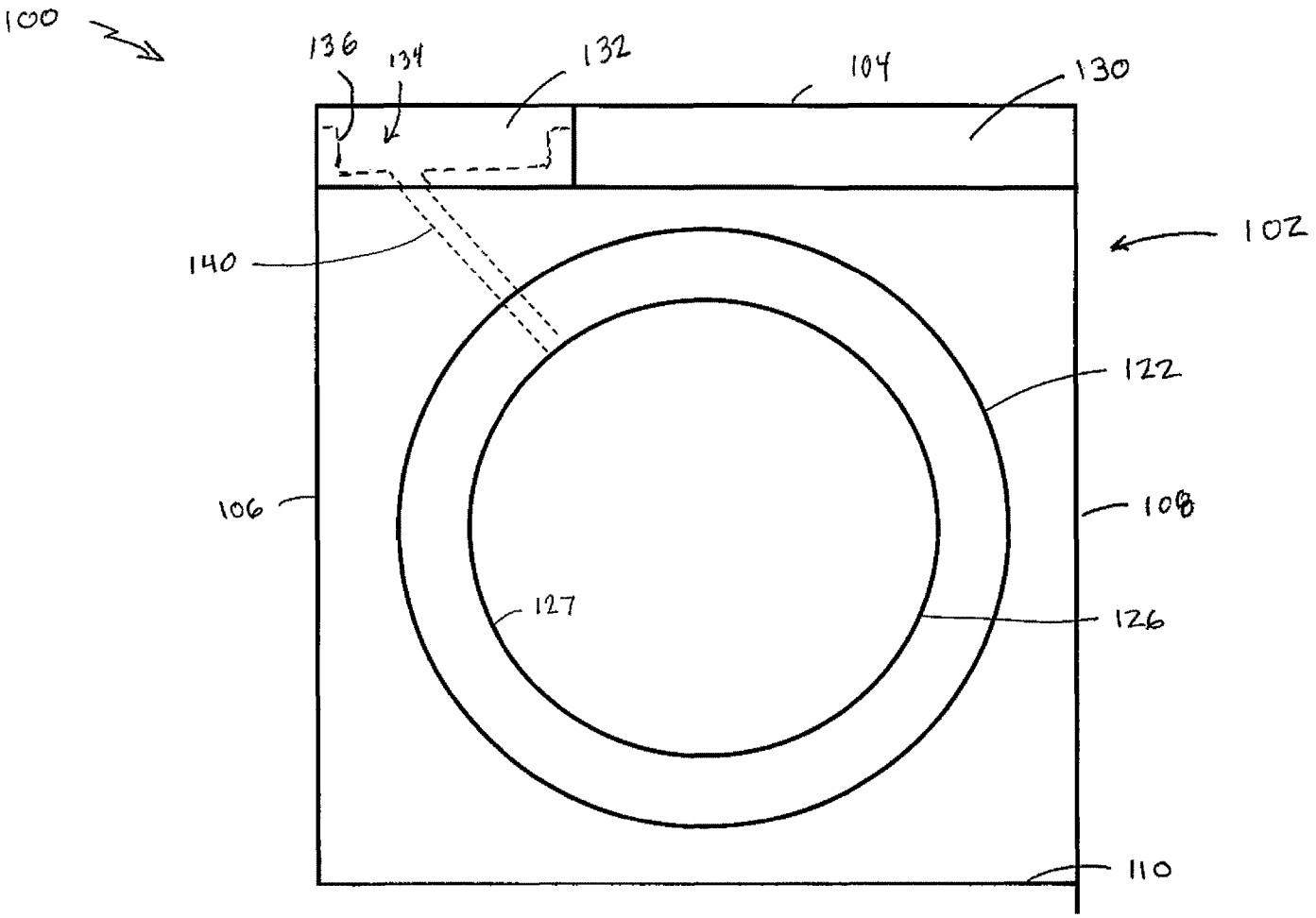
FIG. 1 is a schematic illustration of a front view of an exemplary embodiment of a washing machine.

The description and figures disclose appliances (e.g., washing machines, dishwashers, etc.) having acoustically insulated ductwork. Referring to FIG. 1, the illustrated machine 100 is front-loading washing machine. The term "washing machine," as used herein, is defined to mean a machine designed to wash laundry items, such as clothing, towels, and sheets, that uses water as the primary cleaning agent. The term "front-loading," as used herein, is defined to mean that an internal basket configured to retain laundry items during the washing cycle is oriented in a forward facing direction and that the laundry items enter the basket from a front opening in the washing machine 100. However, the acoustic ductwork disclosed by this application can be used with any machine having a noise generating component. Thus, the machine 100 may take a wide variety of different forms, such as a clothes washing machine, a dishwasher, an air conditioner, a refrigerator, a freezer, or any other household machine or appliance that makes noise.

The illustrated washing machine 100 includes a cabinet or housing 102 having a top surface 104, a first side surface 106, a second side surface 108 opposite the first side surface 106, a front surface 110 extending between the first and second side surfaces 106, 108, and a back surface 112 opposite the front surface 110. As shown in FIG. 1, the cabinet 102 is configured to provide an enclosure for the internal components of the washing machine 100. However, the cabinet 102 can take a variety of different forms. The cabinet 102 can be made from a wide variety of different materials and/or combinations of materials. Examples of suitable materials for the cabinet 102 include, but are not limited to, plastic, fiberglass reinforced plastic, any type of sheet metal, etc. The cabinet 102 may have any finish. The cabinet 102 can be made from stainless steel sheet metal, and can have other desired finishes, such as for example a clear lacquer finish. In some exemplary embodiments, the cabinet 102 is made from sheet metal and covered with a finish such as an enamel based finish.

The front surface 110 of the cabinet includes an opening 114. While the illustrated embodiment shows the cabinet 102 as having a generally rectangular cross-sectional shape, it should be appreciated that the cabinet can have other cross-sectional shapes.

The washing machine 100 includes a tub assembly 122, a motor assembly 124 and a basket 126. The tub assembly 122 is suspended within the cabinet 102 and is configured to retain water used for washing the laundry items. The tub assembly 122 can take a wide variety of different forms and can be made from a wide variety of different materials. The tub assembly 122 may be generally cylindrical with a forward-facing opening 128 as shown, but may take a variety of different shapes. The tub assembly 122 forms an internal compartment 127 the houses the basket 126. The tub assembly 122 may be made from plastic/polymeric materials, or metals, such as stainless steel and aluminum. Preferably, the tub assembly 122 is made from a material that is resistant to corrosion when exposed to water or at least the inside surface of the tub is coated with a material that is resistant to corrosion when exposed to water.

Figure 2:
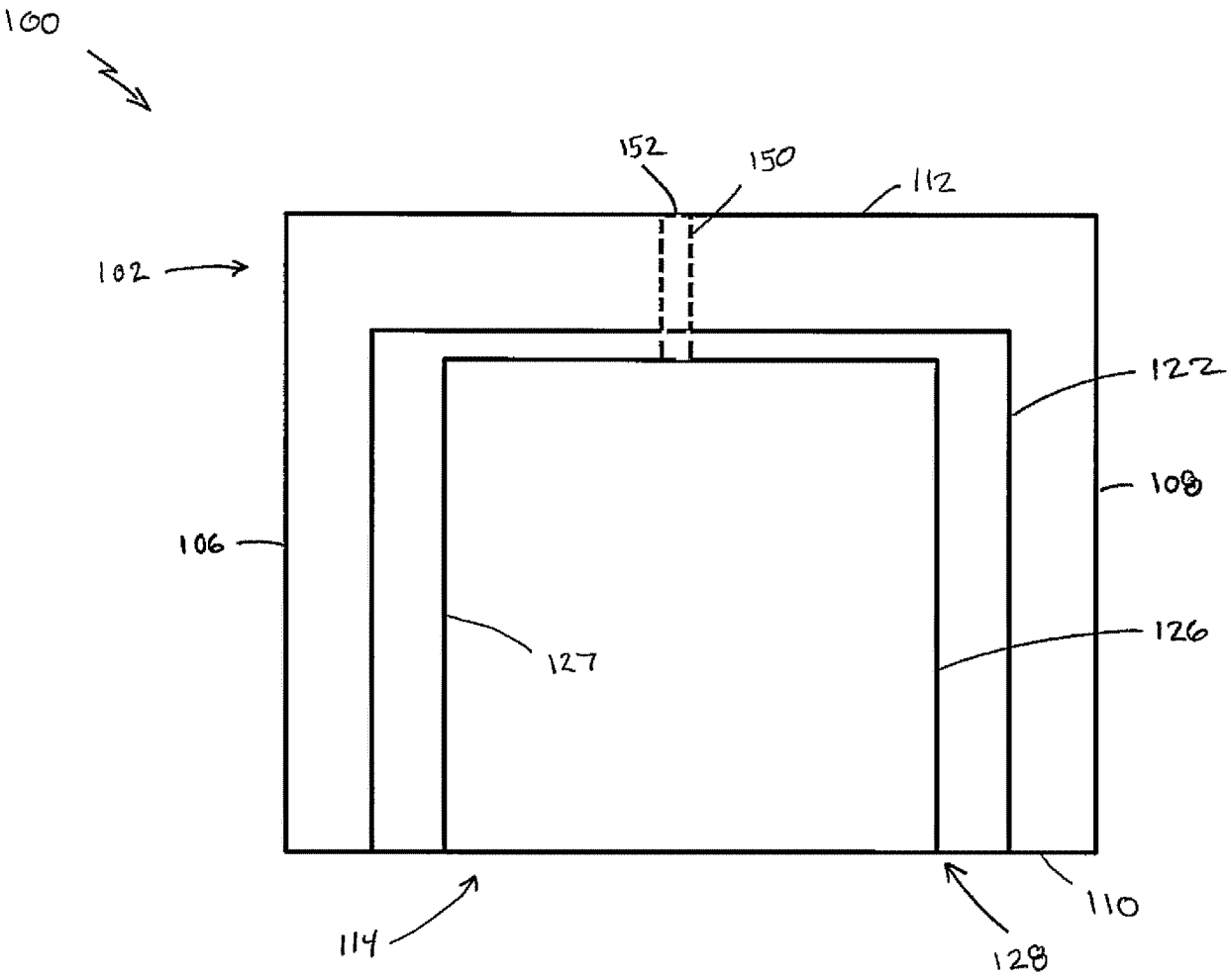
FIG. 2 is a schematic illustration of a top view of the washing machine of FIG. 1.

The motor assembly 124 is operatively connected to the basket 126 and configured to rotate the basket 126 (see FIG. 2). The motor assembly 124 may take a wide variety of different forms and may be operatively coupled to the basket 126 in many different ways, such as for example, by a belt and pulley arrangement. In the illustrated embodiment, the motor assembly 124 is mounted onto the back of the tub assembly 122 and is directly coupled to the basket 126. Operation of the motor assembly 124, rotation of the basket 126, and the vibration of the washing machine 100 may be viewed as noise generating sources.

The basket 126 is positioned within the compartment 127 of the tub assembly 122 and configured to retain the laundry items during the washing cycle. The basket 126 can take a wide variety of different forms and can be made from a wide variety of different materials. The basket 126 may be generally cylindrical with a forward facing opening as shown, but may take a variety of different shapes. The basket 126 may be made from plastic/polymeric materials, or metals, such as steel, stainless steel, and aluminum. Preferably, the basket 126 is made from a material that is resistant to corrosion when exposed to water or is coated with a material that is resistant to corrosion when exposed to water.

The washing machine 100 may include a user interface 130. The user interface 130 may be configured in a variety of ways, including shape, size, orientation, and location on the washing machine 100. In the illustrated embodiment, the user interface 130 is positioned on the front surface 110 in the top right corner. The user interface 130 includes controls (not shown) to allow the user to operate the washing machine 100.

The washing machine 100 may also include a detergent dispenser 132, such as a detergent dispenser drawer. The detergent dispenser 132 may be configured in a variety of ways, including shape, size, orientation, and location on the washing machine 100. In the illustrated embodiment, the detergent dispenser 130 may include a drawer positioned on the front surface 110 in the top left corner. The detergent dispenser 130 includes one or more inlets 134 and one or more receptacles 136 that allow a user to load the detergent dispenser 130 with laundry products, such as laundry detergent, bleach, fabric softener, etc., for the controlled release of these products into the basket 126 during a wash cycle. The detergent dispenser 130 is in fluid communication with the basket 126 by a first duct 140. The first duct 140 is a passage that allows the laundry products to selectively flow, or be otherwise transported, into the basket 126.

The washing machine 100 also includes a second duct 150 that functions as a safety air duct (FIG. 2). The second duct 150 creates an open (unobstructed) air path from the basket 126 to the exterior of the washing machine 100. In the illustrated embodiment, the second duct 150 extends from the basket 126 to an opening 152 on the back surface 112 of the washing machine 100. The first duct 140 and the second duct 150 are illustrated in FIGS. 1-2 as being straight passages with a constant width or diameter. The first and second ducts 140, 150, however, may not be straight passages and may include changes in width or diameter along the length of the ducts.

For conventional front load washing machines, the first duct 140 and the second duct 150 are made of a plastic or a rubber. This type of material and construction, however, may transmit or otherwise convey unwanted sound along the ducts and to the exterior of the washing machine. In the exemplary embodiment of the washing machine 100 of FIGS. 1-2, the first duct 140 and the second duct 150 are formed by one or more materials that acoustically dampen or absorb sound from the machine, in particular sound that would typically resonate along the first and second ducts in a conventional washing machine.

The material used in the first duct 140 and the second duct 150 may be configured in a variety of ways. Any material or materials that reduce sound transmission through the ducts 140, 150 may be used. For example, in one exemplary embodiment, the first duct 140 and the second duct 150 include at least one sound absorbing material. The first duct 140 and the second duct 150 may be made of the same material(s) or may be made of different materials.

Figure 3:
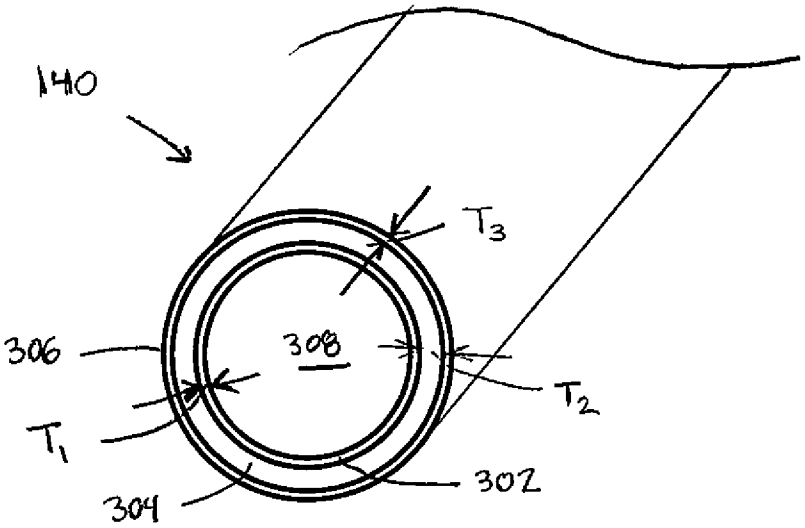
FIG. 3 is a cross section view of an exemplary embodiment of ductwork for the washing machine of FIG. 1.

In the illustrated embodiment, the first duct 140 is formed from a multi-layered, waterproof, flexible, sound-absorbing blanket including a first layer 302, a second layer 304, and a third layer 306. The first duct 140 is illustrated in FIG. 3 as a cylindrical tube having an inner passage 308 with a constant diameter. In some embodiments, however, the first duct 140 may not be straight, may not be cylindrical, and/or may not have a constant diameter or width along its length. The first duct 140 may include bends or curves, may have a width or diameter of the exterior and/or the inner passage that varies over the length of the first duct 140, and may have a cross sectional shape that is non-circular and/or varies along the length of the first duct 140. The first duct 140 may be any suitable size, shape, orientation, or configuration. Since the first duct 140 may carry liquids from the dispenser 132 to the basket 126, the first duct 140 will typically include one or more water-proof layers.

The first layer 302 forms an inner surface defining the inner passage 308. The first layer 302 may be configured in a variety of ways. Any layer that is water resistant, preferably waterproof, and allows noise energy to pass or transmit through it may be used. In some embodiments, the first layer 302 is both water resistant, or waterproof, and bleach resistant, or bleach proof. For example, in one exemplary embodiment, the first layer 302 is a thin, elastic, water-proof film that allows noise energy to be transmitted through the film to the second layer 304. Any suitable materials may be used for the first layer 302. Suitable material for the first layer may include, but not be limited to, polyester, such as Mylar, polypropylene, or other similar materials. In the exemplary embodiment, the first layer 302 has a thickness $T_1$ that is less than or equal to 1 mil. The relative thinness of the first layer 302 aids in transmitting noise energy through the layer. In other embodiments, however, the thickness $T_1$ of the first layer may be greater than 1 mil.

The second layer 304 may be configured in a variety of ways. In the illustrated embodiment, the second layer 304 is a porous, sound absorbing layer that may be made from a wide variety of different materials. For example, the second layer 304 may be made from thermoplastic polymers, such as polyester, polyethylene terephthalate (PET), polypropylene, and the like. In one exemplary embodiment, the second layer 304 includes a fibrous material such as, for example, air-laid or spunbond polymer or glass fibers. In one exemplary embodiment, for example, the second layer 304 includes a fine fiber PET material, such as a 2 denier fiber size PET material.

The second layer 304 may be formed with a variety of different densities and lofts, which can be selected to adjust the acoustic performance of the first duct 140. In one exemplary embodiment, the second layer 304 has a density in the range of 8-150 grams per square foot and a thickness in the range of 3-38 mm. In other embodiments, however, the second layer may have a density greater than 150 grams per square foot or less than 8 grams per square foot and a thickness greater than 38 mm or less than 3 mm. Different combinations of materials, lofts, and densities for the second layer 304 may be selected or changed to achieve different acoustic performance characteristics.

The first duct 140 and the second duct 150 may be configured to attenuate sound energy at a variety of frequencies. In one exemplary embodiment, the first duct 140 and the second duct 150 are configured to attenuate low frequency sound energy. Low frequency sound energy may be sound energy in a frequency range of 100 to 800 Hz, a frequency range of 100 to 400 Hz, a frequency range of 100 to 200 Hz, a frequency range of 100 to 150 Hz, or a frequency range of 100 to 125 Hz. In other embodiments, however, the first duct 140 and the second duct 150 are configured to attenuate high frequency sound energy. High frequency sound energy may be sound energy at a frequency that is higher than 800 Hz.

The third layer 306 may be configured in a variety of ways. For example, the materials used in the third layer 306 may be selected to serve different functions in different embodiments, such as abrasion resistance and noise transmission or reflection. In one exemplary embodiment, the third layer 306 may be a breathable layer having a porosity and thickness configured to allow noise energy to be transmitted through the third layer 306. The third layer 306 may be selected to allow noise within only a certain frequency range to transmit through the third layer 306. In another exemplary embodiment, the third layer 306 may be a noise reflective layer configured to reflect noise back into the second layer 304.

The material or materials used in the third layer 306 may be any suitable material the performs the desired function. For example, if the third layer 306 is configured to reflect noise back into second layer 304, any suitable noise reflecting material may be used. Similarly, if the third layer 306 is configured to allow noise to transmit through the third layer 306, any suitable material that allows noise to transmit through the third layer 306 may be used. For example, the third layer 306 may be the same or similar material to the first layer 402 of the second duct 150, described below.

In some exemplary embodiments, the third layer 306 may be a polymer film, such as polyester or polypropylene, having a thickness $T_3$. Thin films, such as films having a thickness at or below 2 mils, may be suitable for allowing some noise energy to be transmitted through the third layer 306. In one exemplary embodiment, the third layer 306 has a thickness $T_3$ in the range of 0.5-2.0 mils, or 0.5-1.0 mils, or about 0.7 mils.

Thicker films, such as films having a thickness greater than 2 mils, may be suitable for reflecting noise energy back into the second layer 304. In one exemplary embodiment, the third layer 306 has a thickness $T_3$ greater than 2.0 mils, or greater than 3.0 mils, or greater than 5.0 mils. In one exemplary embodiment, the third layer 306 is an air barrier having an airflow resistance at or greater than about 3000 Rayls.

Figure 4:
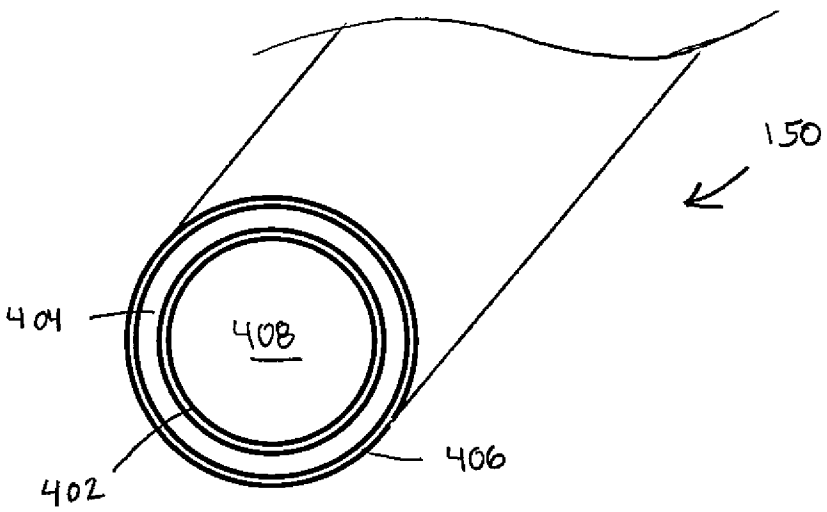
FIG. 4 is a cross section view of another exemplary embodiment of ductwork for the washing machine of FIG. 1.

In the illustrated embodiment, the second duct 150 is a multi-layered, breathable, flexible material including a first layer 402, a second layer 404, and an optional third layer 406. The second duct 150 is illustrated in FIG. 4 as a cylindrical tube having an inner passage 408 with a constant diameter. In some embodiments, however, the second duct 150 may not be straight, may not be cylindrical, and/or may not have a constant diameter. The second duct 150 may include bends or curves, may have a width or diameter of the exterior and/or the inner passage 408 that varies over the length of the second duct 150, and may have a cross sectional shape that is non-circular and/or varies along the length of the second duct 150. The second duct 150 may be any suitable size, shape, orientation, or configuration. Since the second duct 150 is a safety air vent for the basket 126, the second duct 150 may include an air flow control layer.

The first layer 402 forms an inner surface defining the inner passage 408. The first layer 402 may be configured in a variety of ways. In an exemplary embodiment, the first layer 402 is a relatively permeable layer that allows noise and air to pass through the first layer 402. For example, the first layer 402 may have an airflow resistance between about 600-1400 Rayls. The first layer 402 may have an airflow resistance between 900-1400 Rayls. The first layer 402 may be selected to have an airflow resistance of about 900 Rayls, about 1100 Rayls, or about 1400 Rayls. However, other airflow resistances can be selected. In one exemplary embodiment, the first layer 402 in the embodiment illustrated by FIG. 4 may have an airflow resistance of about 900, 1100, and/or 1400 Rayls.

The first layer 402 can be made from a wide variety of different materials and may have a variety of different thicknesses. For example, any material having the airflow resistance described above can be used. Examples of acceptable materials for the first layer 402 include, but are not limited to polypropylene, PET, non-porous materials that are perforated to allow airflow, such as perforated metal foil, perforated polymer material, such as a Teflon sheet that has been perforated to allow airflow. In another embodiment, acceptable materials for the first layer 402 include, but are not limited to non-porous materials that are not perforated to allow airflow, such as metal foil, polymer material, such as a Teflon sheet.

The first layer 402 may have a wide variety of different densities and thicknesses. In an exemplary embodiment, the first layer 402 is much denser than the second layer 404. For example, in the embodiment illustrated by FIG. 4, the first layer 402 may be a polypropylene, polyester, and/or PET (Polyethylene terephthalate) material, such as a spunbond/meltblown/spunbond sheet that is 50 grams per square meter (gsm). In the exemplary embodiment, the first layer 402 has a thickness $T_4$ that is at or below 2 mils, or in the range of 0.5-2.0 mils, or 0.5-1.0 mils, or at about 0.7 mils.

The second layer 404 may be configured m a variety of ways. In the illustrated embodiment, the second layer 404 may be the same sound absorbing material as the second layer 304 of the first duct 140. The second layer 404 has a thickness $T_5$ in the range of 3-38 mm.

Some exemplary embodiments of the second duct 150 include the optional third layer 406. If present, the third layer 406 may be configured in a variety of ways. For example, the third layer 406 may be selected from a material described above in relation to the third layer 306 of the embodiment of FIG. 3. The description of the third layer 306 applies equally to the third layer 406. Thus, the materials used in the third layer 406 may be selected to serve different functions in different embodiments, such as abrasion resistance and noise transmission or reflection. In one exemplary embodiment, the third layer 406 may be a breathable layer having a porosity and thickness configured to allow noise energy to be transmitted through the third layer 406. The third layer 406 may be selected to allow noise within only a certain frequency range to transmit through the third layer 406. In another exemplary embodiment, the third layer 406 may be a noise reflective layer configured to reflect noise back into the second layer 404.

In operation, the first duct 140 is in fluid communication with the basket 126 such that laundry products may be directed into the basket 126 during a wash cycle. In addition, the second duct places the basket 126 into fluid communication with an area external to the washing machine to provide an open-air passage (i.e., child safety air vent). The construction of the first duct 140 and the second duct 150 reduce or eliminate unwanted sound from the mechanical components of the washing machine and/or vibration of the machine, transmitted through the first and second duct 140, 150 to the exterior area surrounding the machine.

Figure 5:
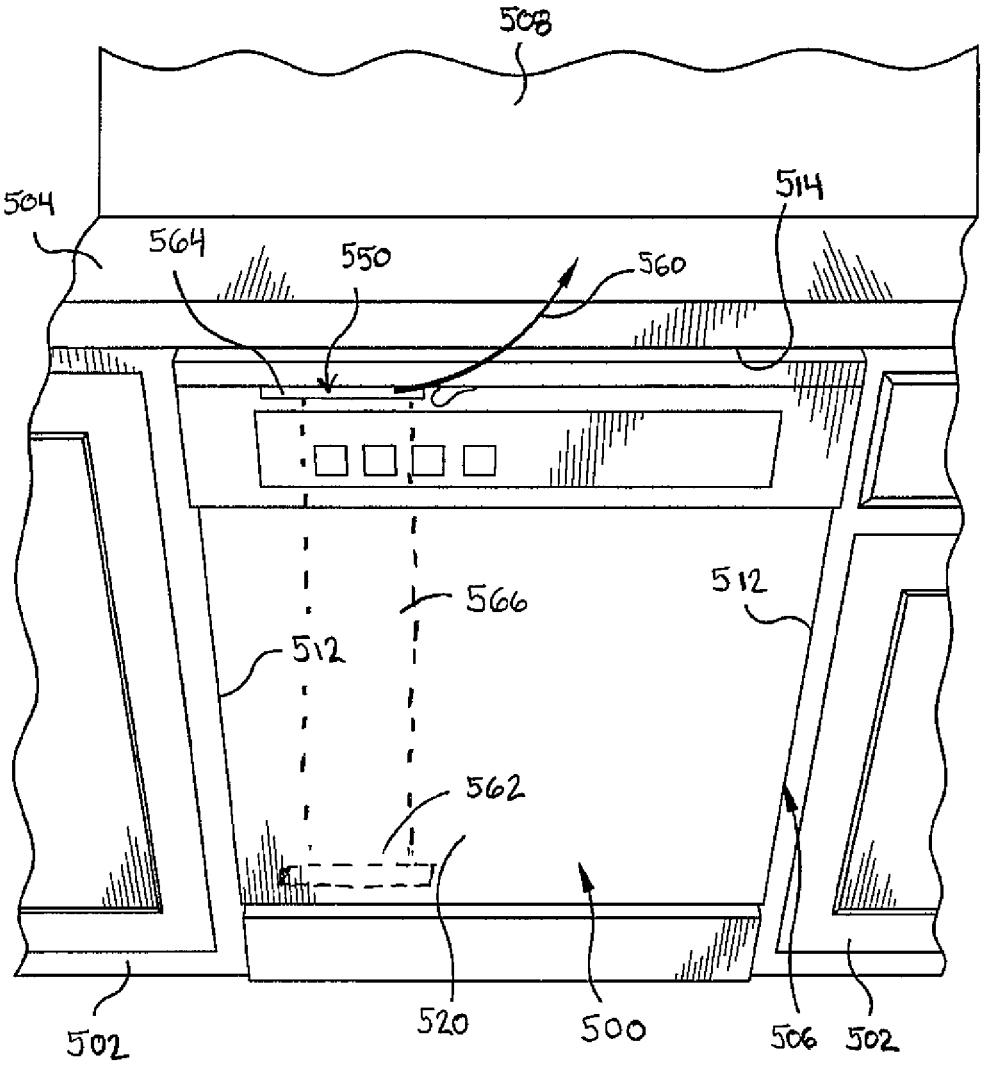
FIG. 5 is a front view of an exemplary embodiment of a dishwasher installed in a cabinet under a countertop.
Figure 6:
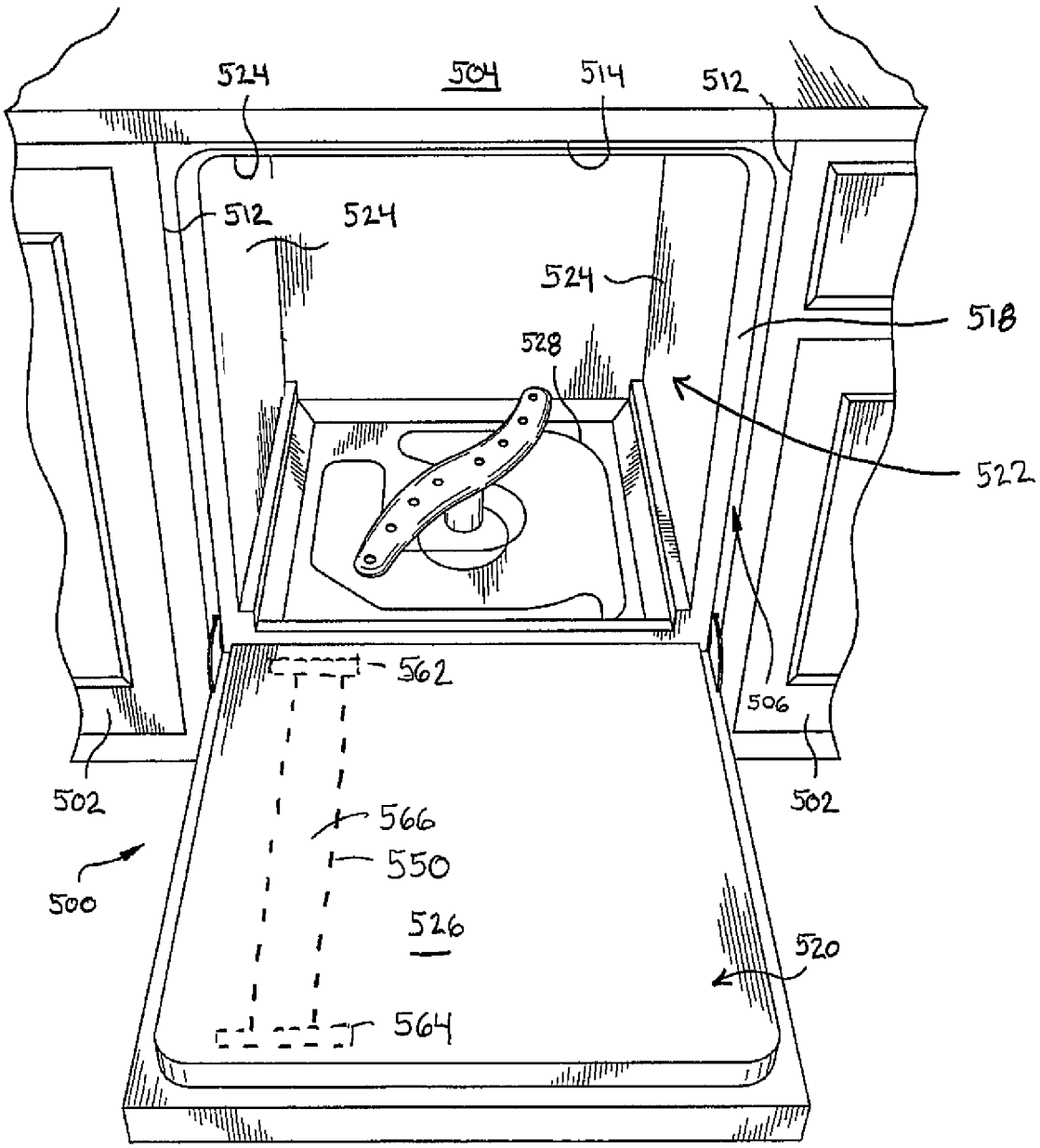
FIG. 6 is a front view of the dishwasher of FIG. 5 with the front door open.

Referring to FIGS. 5-6, the illustrated is a dishwasher 500. FIG. 5 illustrates a dishwasher 500 installed between cabinets 502 and under a countertop 504. As such, a cavity 506 that the dishwasher 500 is installed in is bounded by the sides 512 of the cabinets 502, by the bottom 514 of the countertop 504, and by a wall 508 of the kitchen. The dishwasher 500 includes a housing 518 and a front door 520 pivotably coupled to the housing 518. The dishwasher 500 may include an inner compartment or tub 522 defined by a plurality of inner side surfaces 524 associated with the housing 518 and an inner side surface 526 of the front door 520. The inner compartment 522 may include a heating element 528.

In an exemplary embodiment, the dishwasher 500 also includes an exhaust duct 550. The exhaust duct 150 allows gas, such as water vapor that forms when water is heated in the washing and drying cycles of the dishwasher, to exit the dishwasher 500 as indicated by arrow 560. The exhaust duct 550 may be configured in a variety of ways and can take a wide variety of different forms. The exhaust duct 550 may be positioned through the front door 504 as illustrated in FIGS. 5-6. In other embodiments, however, the exhaust duct 550 may be provided at other locations on the dishwasher 550, such as through one or more of the inner side surfaces 524 of the housing 518.

In the illustrated embodiment, dishwasher includes an inlet 562 positioned at or near the bottom of the front door 520 and an outlet 564 positioned at or near the top of the front door 520. In the illustrated embodiment, the inlet 562 and the outlet 564 are rectangular. In other embodiment, however the inlet 562 and the outlet 564 may be other than rectangular and can be any suitable shape(s).

The exhaust duct 550 defines a passage 566 (shown as dashed lines in FIGS. 5-6) extending upward within the front door 520 and in fluid communication with the inner compartment 522 via the inlet 562, and in fluid communication with an area exterior of the housing 518 via the outlet 564. In the illustrated embodiment, the passage 566 is illustrated as straight. In other embodiments, however, the passage 566 may include curved, corners, or other non-linear portions.

The material used in the exhaust duct 550 may be configured in a variety of ways. Any material or materials that reduce sound transmission through the exhaust duct 550 may be used. For example, in one exemplary embodiment, the exhaust duct 550 includes at least one sound absorbing material. The exhaust duct 550 may be configured the same as the first duct 140 or the second duct 150. In other embodiments, however, the exhaust duct 550 may include one or more materials different than the first duct 140 or the second duct 150.

Figure 7:
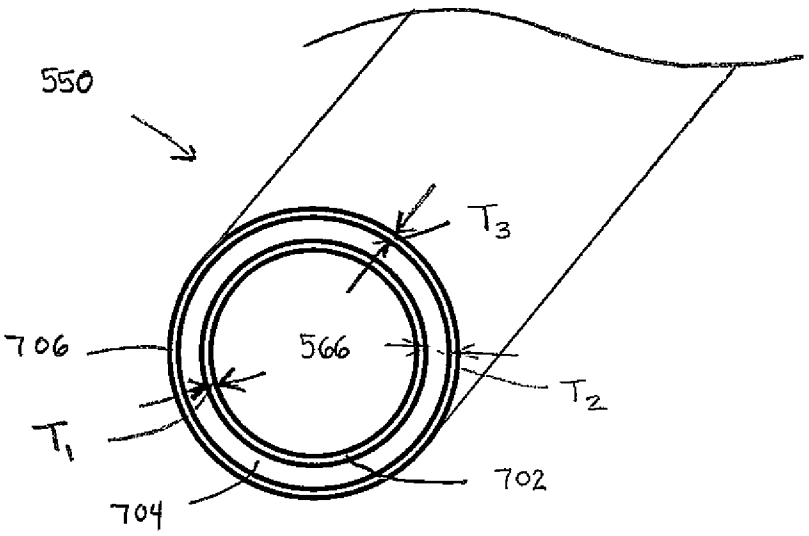
FIG. 7 is a cross section view of an exemplary embodiment of ductwork for the dishwasher of FIG. 5.

Referring to FIG. 7, in the illustrated embodiment, the exhaust duct 550 is formed from a multi-layered, waterproof, flexible, sound-absorbing blanket including a first layer 702, a second layer 704, and a third layer 706. The exhaust duct 550 is illustrated in FIG. 7 as a cylindrical tube having with the passage 566 having a constant diameter. In some embodiments, however, the exhaust duct 550 may not be straight, may not be cylindrical, and/or may not have a constant diameter or width along its length. The exhaust duct 550 may include bends or curves, may have a width or diameter of the exterior and/or the inner passage that varies over the length of the exhaust duct 550, and may have a cross sectional shape that is non-circular and/or varies along the length of the exhaust duct 550. The exhaust duct 550 may be any suitable size, shape, orientation, or configuration.

For example, in one exemplary embodiment, the exhaust duct 550 is generally cylindrical, but, to fit within the front door 520, the exhaust duct 550 is flattened, without obstructing the passage 566, to a profile with a width greater than a thickness. Further, the exhaust duct 550 is sufficiently flexible to be shaped to complement the rectangle shape of the inlet 562 and the outlet 564 where the exhaust duct 550 meets up with the inlet 562 and the outlet 564.

Since the exhaust duct 550 may carry moist air from inner compartment 522, such as during the drying cycle, the exhaust duct 550 will typically include one or more waterproof layers.

The first layer 702 forms an inner surface defining the passage 566. The first layer 702 may be configured in a variety of ways. Any layer that is water resistant, preferably waterproof, and allows noise energy to pass or transmit through it may be used. For example, in one exemplary embodiment, the first layer 702 is a thin, elastic, water-proof film that allows noise energy to be transmitted through the film to the second layer 704. Any suitable materials may be used for the first layer 702. Suitable material for the first layer 702 may include, but not be limited to, polyester, such as Mylar, polypropylene, or other similar materials. In the exemplary embodiment, the first layer 702 has a thickness $T_1$ that is less than or equal to 1 mil. The relative thinness of the first layer 702 aids in transmitting noise energy through the layer. In other embodiments, however, the thickness $T_1$ of the first layer 702 may be greater than 1 mil.

The second layer 704 may be configured in a variety of ways. In the illustrated embodiment, the second layer 704 is a porous, sound absorbing layer that may be made from a wide variety of different materials. For example, the second layer 304 may be made from thermoplastic polymers, such as polyester, polyethylene terephthalate (PET), polypropylene, and the like. In one exemplary embodiment, the second layer 704 includes a fibrous material such as, for example, air-laid or spunbond polymer or glass fibers. In one exemplary embodiment, for example, the second layer 704 includes a fine fiber PET material, such as a 2 denier fiber size PET material.

The second layer 704 may be formed with a variety of different densities and lofts, which can be selected to adjust the acoustic performance of the exhaust duct 550. In one exemplary embodiment, the second layer 704 has a density in the range of 8-150 grams per square foot and a thickness in the range of 3-38 mm. In other embodiments, however, the second layer 704 may have a density greater than 150 grams per square foot or less than 8 grams per square foot and a thickness greater than 38 mm or less than 3 mm. Different combinations of materials, lofts, and densities for the second layer 304 may be selected or changed to achieve different acoustic performance characteristics.

The exhaust duct 550 may be configured to attenuate sound energy at a variety of frequencies. In one exemplary embodiment, the exhaust duct 550 is configured to attenuate low frequency sound energy. Low frequency sound energy may be sound energy in a frequency range of 100 to 800 Hz, a frequency range of 100 to 400 Hz, a frequency range of 100 to 200 Hz, a frequency range of 100 to 150 Hz, or a frequency range of 100 to 125 Hz. In other embodiments, however, the exhaust duct 550 is configured to attenuate high frequency sound energy. High frequency sound energy may be sound energy at a frequency that is higher than 800 Hz.

The exhaust duct 550 may be configured in a variety of ways. For example, the materials used in the exhaust duct 550 may be selected to serve different functions in different embodiments, such as abrasion resistance and noise transmission or reflection. In one exemplary embodiment, the third layer 706 may be a breathable layer having a porosity and thickness configured to allow noise energy to be transmitted through the third layer 706. The third layer 706 may be selected to allow noise within only a certain frequency range to transmit through the third layer 706. In another exemplary embodiment, the third layer 706 may be a noise reflective layer configured to reflect noise back into the second layer 704.

The material or materials used in the third layer 706 may be any suitable material the performs the desired function. For example, if the third layer 706 is configured to reflect noise back into second layer 704, any suitable noise reflecting material may be used. Similarly, if the third layer 706 is configured to allow noise to transmit through the third layer 706, any suitable material that allows noise to transmit through the third layer 706 may be used. For example, the third layer 706 may be the same or similar material to the first layer 402 of the second duct 150.

In some exemplary embodiments, the third layer 706 may be a polymer film, such as polyester or polypropylene, having a thickness $T_3$. Thin films, such as films having a thickness at or below 2 mils, may be suitable for allowing some noise energy to be transmitted through the third layer 306. In one exemplary embodiment, the third layer 706 has a thickness $T_3$ in the range of 0.5-2.0 mils, or 0.5-1.0 mils, or about 0.7 mils.

Thicker films, such as films having a thickness greater than 2 mils, may be suitable for reflecting noise energy back into the second layer 704. In one exemplary embodiment, the third layer 306 has a thickness $T_3$ greater than 2.0 mils, or greater than 3.0 mils, or greater than 5.0 mils. In one exemplary embodiment, the third layer 706 is an air barrier having an airflow resistance at or greater than about 3000 Rayls.

In operation, the exhaust duct 550 is in fluid communication with the inner compartment 522 and places the inner compartment 522 into fluid communication with an area external to the dishwasher 500. The dishwasher 500 may include a drying cycle at the end of a wash cycle. During the drying cycle, the heating element 528, or another heating source, may also be utilized to heat the air inside the inner compartment 522 to assist in the drying of contents within the inner compartment 522. Water vaporized by the heat (i.e., steam) can flow out of the exhaust duct 550. Some of the vaporized water may also condense in the exhaust duct 550 and flow back into the inner compartment 522 and out of a drain at the bottom of the inner compartment 522.

The construction of the exhaust duct 550 reduces or eliminates unwanted sound from the dishwasher that can be transmitted through the exhaust duct 550 to the exterior area surrounding the machine.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures can be made from such details without departing from the spirit or scope of the applicant's general inventive concept.

The invention claimed is:

1. A home appliance, comprising:

a housing;

an internal compartment within the housing;

a first duct extending from the internal compartment to an area exterior to the housing, the first duct made from a multilayered material having an inner layer with an inner surface defining a fluid passage of the duct, the inner layer comprising a material that allows sound to be transmitted through the inner layer, and a second layer adjacent the inner layer and containing a sound absorbing material, wherein the inner layer comprises at least one of a water-resistant, elastic film or an air-permeable material having an airflow resistance between about 600-1400 Rayls.

2. The home appliance of claim 1, wherein the inner layer is waterproof.

3. The home appliance of claim 1, wherein the inner layer has a first thickness and the second layer has a second thickness greater than the first thickness.

4. The home appliance of claim 1, wherein the second layer is positioned between the inner layer and a third layer, wherein the third layer allows sound to be transmitted through the third layer.

5. The home appliance of claim 4 wherein the third layer is a polymer layer with a thickness in the range of 0.5 mils to 1 mils.

6. The home appliance of claim 1, wherein the second layer is positioned between the inner layer and a third layer, wherein the third layer comprises a sound reflecting material configured to reflect sound back into the second layer.

7. The home appliance of claim 6, wherein the third layer is a polymer layer with a thickness greater than 3 mils.

8. The home appliance of claim 1, wherein the sound absorbing material is a fibrous material containing one or more of glass fibers and PET fibers.

9. The home appliance of claim 1, wherein the home appliance is a clothing washing machine, and the internal compartment is a basket rotatably mounted within the housing and configured to retain laundry items.

10. The home appliance of claim 1, wherein the home appliance is a dishwasher, the internal compartment is configured to retain dishes, and the first duct is an exhaust duct extending through a front door of the dishwasher.

11. A dishwasher, comprising:

a housing;

a door pivotably attached to the housing; wherein the housing and door define an inner compartment configured to hold dishes during a washing cycle and a drying cycle;

an exhaust duct extending from the inner compartment to an exterior of the housing through the door, the exhaust duct made from a multilayered material having an inner layer with an inner surface defining a fluid passage of the exhaust duct, the inner layer comprising a material that allows sound to be transmitted through the inner layer, and a second layer adjacent the inner layer and containing a sound absorbing material, wherein the inner layer comprises at least one of a water-resistant, elastic film or an air-permeable material having an airflow resistance between about 600-1400 Rayls.

12. The dishwasher of claim 11, wherein the inner layer is waterproof.

13. The dishwasher of claim 11, wherein the inner layer has a first thickness and the second layer has a second thickness greater than the first thickness.

14. The dishwasher of claim 11, wherein the second layer is positioned between the inner layer and a third layer, wherein the third layer comprises a sound reflecting material configured to reflect sound back into the second layer.

15. The dishwasher of claim 11, wherein the sound absorbing material is a fibrous material containing one or more of glass fibers and PET fibers.

16. The home appliance of claim 3 wherein the first thickness is 2 mils or less and the second thickness is in the range of 3-38 mm.

17. The home appliance of claim 6 wherein the third layer has an airflow resistance of 3000 Rayls or greater.

18. The home appliance of claim 1, wherein the first layer is an elastic, polymer film having a thickness of 1 mil or less.

19. The home appliance of claim 1, wherein the first layer is perforated.

20. The home appliance of claim 1, wherein the fluid passage is configured as an unobstructed safety air duct.

* * * * *